US007571659B2

(12) United States Patent
Horikoshi

(10) Patent No.: US 7,571,659 B2
(45) Date of Patent: Aug. 11, 2009

(54) STARTING APPARATUS OF SMALL-SIZED ENGINE

(75) Inventor: Yoshinori Horikoshi, Tokyo (JP)

(73) Assignee: Starting Industrial Co., Ltd., Tokyo (JP)

( * ) Notice: Subject to any disclaimer, the term of this patent is extended or adjusted under 35 U.S.C. 154(b) by 419 days.

(21) Appl. No.: 11/440,055

(22) Filed: May 25, 2006

(65) Prior Publication Data

US 2006/0266138 A1 Nov. 30, 2006

(30) Foreign Application Priority Data

May 27, 2005 (JP) ..... P2005-156003

(51) Int. Cl.
*F02N 15/06* (2006.01)
*F02N 17/00* (2006.01)
*F02N 15/02* (2006.01)

(52) U.S. Cl. ..... 74/6; 74/7 R; 74/7 C; 74/7 E; 192/46

(58) Field of Classification Search ..... 74/6, 74/7 R, 7 A, 7 B, 7 C, 7 D, 7 E, 8, 9; 192/46, 192/69.81, 89.27; *F02N 15/06*
See application file for complete search history.

(56) References Cited

U.S. PATENT DOCUMENTS 4,155,228 A * 5/1979 Burgener et al. ..... 192/46
4,157,083 A 6/1979 Smith et al.
4,848,288 A * 7/1989 Murase et al. ..... 74/6
4,922,868 A 5/1990 Ohkanda
5,010,858 A * 4/1991 Schierling et al. ..... 74/7 C
5,072,627 A * 12/1991 Horiye et al. ..... 74/6
5,769,197 A * 6/1998 Kest et al. ..... 192/46
6,199,529 B1 3/2001 Kuwabara et al.
6,240,889 B1 * 6/2001 Kuwabara et al. ..... 123/179.24
6,374,791 B1 * 4/2002 Kuwabara et al. ..... 123/179.25

FOREIGN PATENT DOCUMENTS

JP 2521096 5/1996

OTHER PUBLICATIONS

Patent Abstract of Japan, vol. 14, No. 323 (M-0997), Jul. 11, 1990 and JP 02 108855 A (Yanmar Diesel Engine Co. Ltd.).
Patent Abstract of Japan, vol. 13, No. 25 (M-787), Jan. 20, 1989 and JP 63 235663 A (Maruyama Seisakusho KK).

* cited by examiner

*Primary Examiner*—Richard W L Ridley
*Assistant Examiner*—Timothy J Murphy
(74) *Attorney, Agent, or Firm*—Nixon & Vanderhye P.C.

(57) ABSTRACT

A starting apparatus of a small-sized engine includes: a cylindrical cam; a drive gear connected to the cylindrical cam coaxially, wherein: whereas the drive gear is made to be connected to a rope reel by ratchet claws, the drive gear is made to be connected to a cell motor by at least two pieces of reduction gears; and a reduction gear in the reduction gears brought in mesh with the drive gear is divided into a small diameter gear portion and a large diameter gear portion to be arranged coaxially, side faces of the small and the large diameter gear portion opposed to each other are formed with engaging claws engaged with each other only in one direction, and the small and the large diameter gear portion are urged as the two side faces are brought into contact with each other.

2 Claims, 5 Drawing Sheets

STARTING APPARATUS OF SMALL-SIZED ENGINE

BACKGROUND OF THE INVENTION

1. Field of the Invention

The present invention relates to a starting apparatus of a small-sized engine combined with an electric cell motor and a recoil starter for pulling a starter rope wound around a rope reel which is used as starting apparatus of a small-sized engine.

2. Background Art

When a starting mechanism by a cell motor and a starting mechanism by a rope reel are combined, a transmission system by the cell motor and a transmission system by the rope reel need to be switched selectively. Hence, in a background art, there is known a constitution adopting a reduction gear attached with a one way clutch by a one way needle bearing for a reduction gear of reduction gears connected to a cell motor most proximate to a transmission system by a rope reel. Thereby, in starting by the cell motor, the cell motor is connected to an output shaft of an engine to transmit a rotational force thereof, and in starting by the recoil starter by the rope reel, the output shaft is cut from the transmission system by pulling the recoil rope. Further, the reduction gear attached with the one way clutch is used by press-fitting the one way needle bearing to a shaft hole of the reduction gear, as disclosed in Japanese Patent No. 2521096.

SUMMARY OF THE INVENTION

An operation of press-fitting the one way needle bearing to the shaft hole of the reduction gear requires a high dimensional accuracy for the press-fitting shaft and the press-fitted shaft hole and also needs hardness and therefore, depending on cases, there poses a problem that the shaft and the shaft hole needs to be quenched and also cost of the bearing per se is high. Further, there is brought about a rare case in which the one way needle bearing is rotated idly even in a rotational direction for transmitting a torque under an adverse environment. For example, a minimum of an allowable temperature of use of the one way needle bearing is −10° C., at low temperatures exceeding the allowable temperature, there is brought about a phenomenon in which the one way needle bearing slips and the force is not transmitted. Further, when the one way needle bearing is used in an inclined state, a load is applied in a radial direction, a force is concentrated locally and therefore, the bearing is easy to be destructed, and a problem is posed in view of reliability thereof.

It is a goal of the invention to resolve the above-described problem to provide a staffing apparatus of a small-sized engine capable of achieving a reduction in integrating steps and cost and having high reliability.

In order to resolve the above-described problem, according to an aspect of the invention, there is provided a staffing apparatus of a small-sized engine including: a cylindrical cam having a cam claw engaged with a centrifugal ratchet of a pulley fixed to a crankshaft of an engine; and a drive gear connected to the cylindrical cam by a damper spring at an inner portion of a starter case, wherein: the cylindrical cam is coaxially arranged with the drive gear; whereas the drive gear is made to be connected to a rope reel engaged therewith and disengaged therefrom by ratchet claws formed at respective side faces thereof, the drive gear is made to be connected to a cell motor by at least two pieces of reduction gears; and a reduction gear in the reduction gears brought in mesh with the drive gear is divided into a small diameter gear portion and a large diameter gear portion to be arranged coaxially, side faces of the small diameter gear portion and the large diameter gear portion opposed to each other are formed with engaging claws engaged with each other only in one direction, and the small diameter gear portion and the large diameter gear portion are urged as the two side faces are brought into contact with each other.

According to the aspect of the invention, in rotating the cell motor, when engaging projected portions formed at the side faces of the small diameter gear portion and the large diameter gear portion opposed to each other of the reduction gear brought in mesh with the drive gear are made to be engaged with each other, rotation of the cell motor is transmitted to the drive gear, and is further transmitted to the pulley by way of the cylindrical cam and the engine is rotated. At this occasion, by setting the drive gear and the rope reel such that the ratchet claws are not engaged with each other, rotation of the cell motor is not transmitted to the rope reel.

In contrast thereto, in rotating the rope reel, the respective ratchet claws of the drive gear and the rope reel are engaged with each other and therefore, rotation of the rope reel is transmitted to the drive gear and is further transmitted to the pulley by way of the cylindrical cam and the engine is rotated. At this occasion, although the rotation is transmitted to the small diameter gear portion of the reduction gear brought in mesh with the drive gear, by setting the small diameter gear portion and the large diameter gear portion such that the engaging claws are not engaged with each other, from a relationship of a reduction ratio, the large diameter gear portion cannot rotate the other reduction gear brought in mesh therewith. Therefore, the large diameter gear portion is moved to be separated from the small diameter gear portion on a rotating shaft against the compression spring. Therefore, the rotational force of the drive gear is not transmitted to the large diameter gear and therefore, rotation of the rope reel is not transmitted to the cell motor.

In this way, a one way mechanism is constituted by engaging and disengaging the engaging claws, at least two reduction gears are provided, the reduction gear in the reduction gears brought in mesh with the drive gear is constructed by a constitution of being divided into two of the small diameter gear portions and the large diameter gear portions and therefore, the large diameter gear portion is made to rotate the small diameter gear of the reduction gear on the side of the cell motor brought in mesh to be connected therewith, the reduction ratio is large and therefore, the large diameter gear portion needs a large torque for rotating the small diameter gear directly connected therewith, the large diameter gear portion is pushed out by the engaging claw of the small diameter gear portion to be separated from the small diameter gear portion and therefore, the small diameter gear portion is idly rotated and a rotational force thereof is not transmitted to the large diameter gear portion. Therefore, rotation is firmly transmitted thereto or cut therefrom, and the engine can firmly be switched to either of cell motor starting or recoil starting.

In this way, the small diameter gear portion and the large diameter gear portion are inexpensive, both thereof may rotatably be supported by the support shaft and are not needed to be press-fitted with the support shaft, further, the dimensional accuracy is not requested therefor, quenching or the like is not needed therefor, and a number of integrating steps and cost can be reduced.

Further, it is difficult to bring about a phenomenon that a force is not transmitted even at low temperatures, and a low temperature characteristic is promoted. Further, even when a load is applied on the small diameter gear portion and the large diameter gear portion in the radial direction, the torque is transmitted sufficiently and the reliability is significantly promoted.

BRIEF DESCRIPTION OF THE DRAWINGS

Embodiments of the present invention will be described in detail based on the following figures, wherein.

DETAILED DESCRIPTION OF THE EMBODIMENTS

Figure 1:
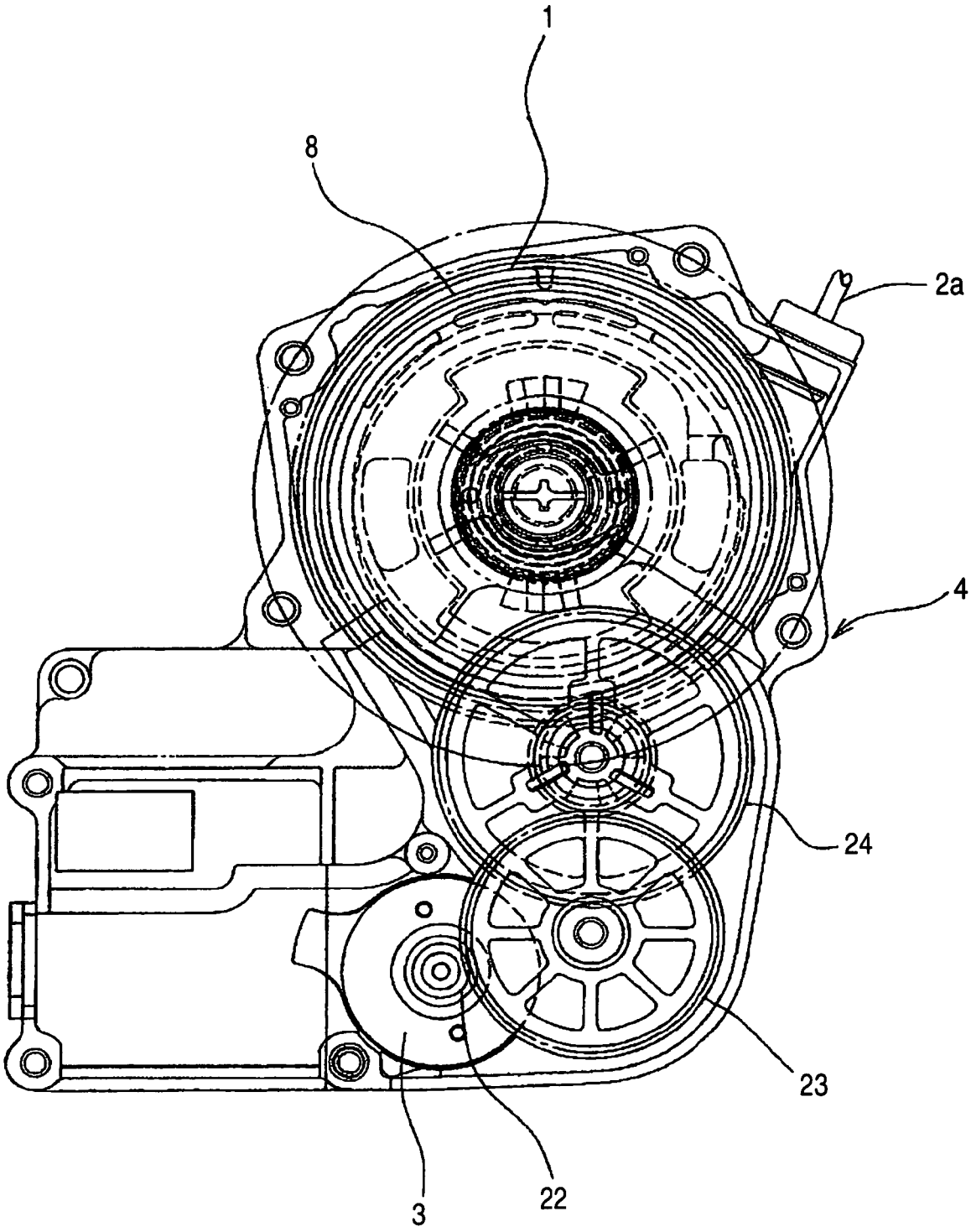
FIG. 1 is a front view of a starter according to the invention.
Figure 2:
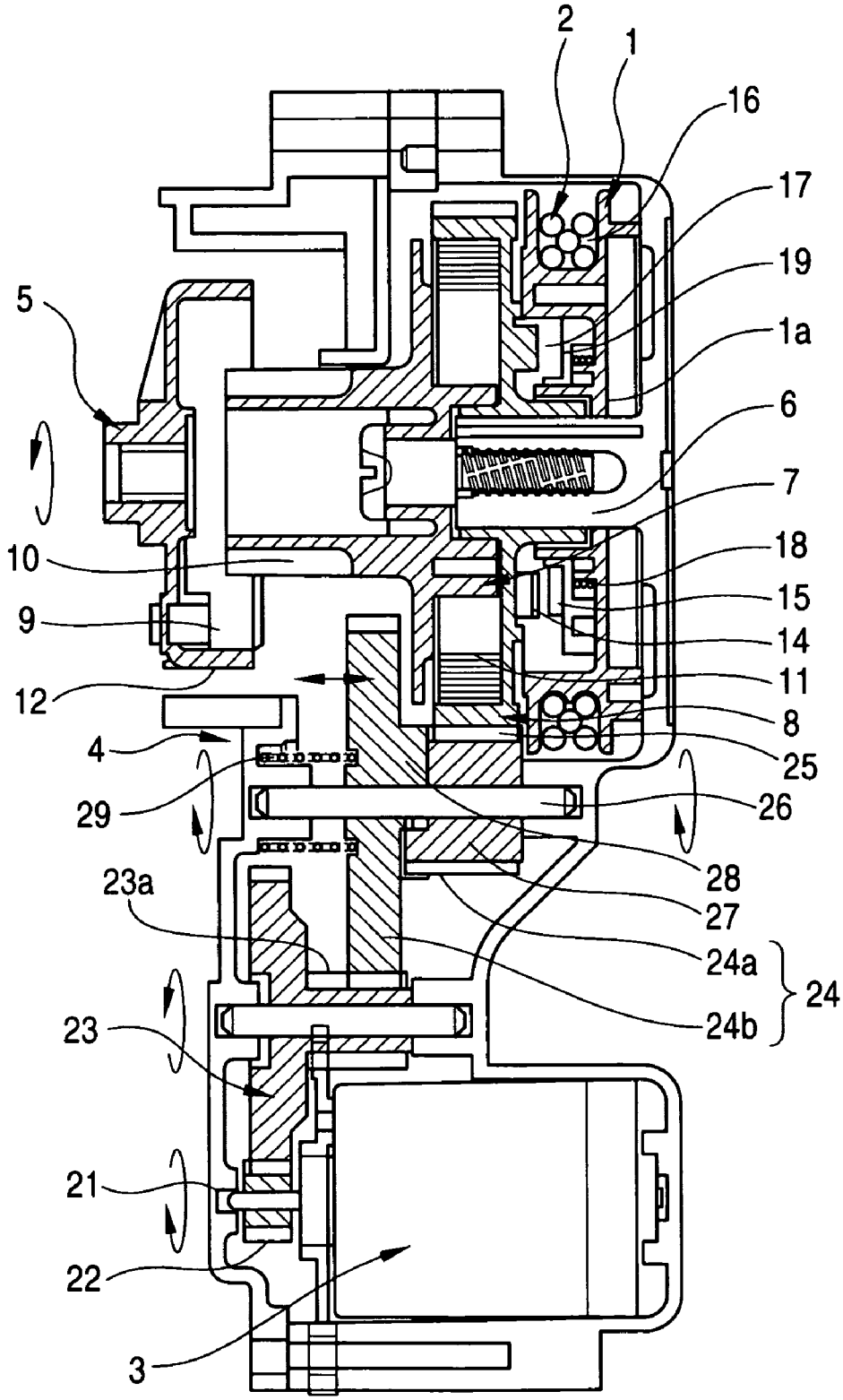
FIG. 2 is a vertical sectional side view of the starter.
Figure 3A:
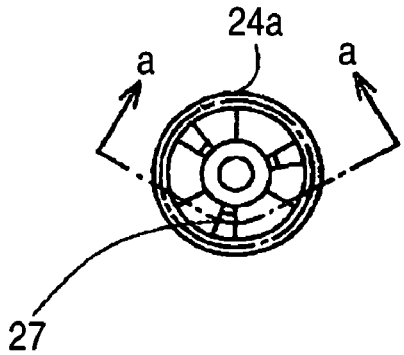
FIGS. 3A and 3B are respectively a front view of a small diameter gear portion and a sectional view thereof taken along a line a-a.
Figure 3B:
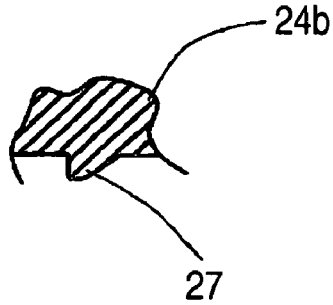
Figure 4A:
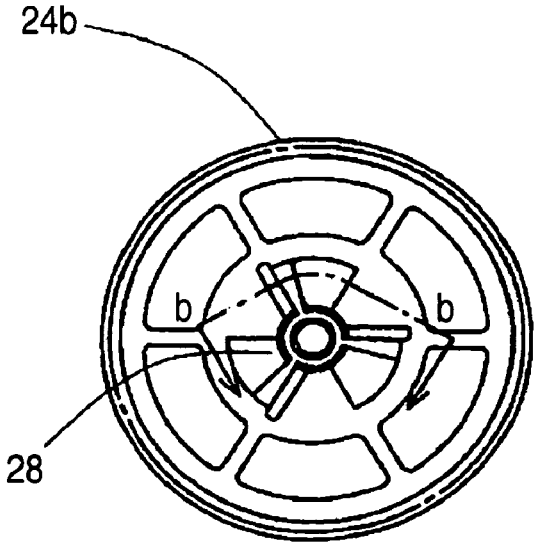
FIGS. 4A and 4B are respectively a front view of a large diameter gear portion and a sectional view thereof taken along a line b-b.
Figure 4B:
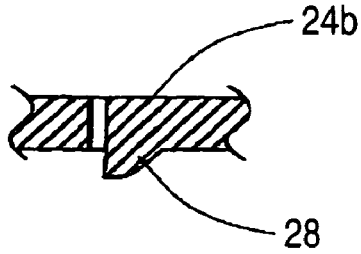

An embodiment of the invention will be explained in reference to the drawings as follows. In FIG. 1 and FIG. 2, a starting apparatus of a small-sized engine is combined with a recoil starter for pulling a starter rope 2 wound around a rope reel 1 and an electric cell motor 3, one side of a starter case 4 is attached with a pulley 5 fixed to a crankshaft of an engine, the starter case 4 is formed with a support shaft 6 coaxially with the pulley 5, and the support shaft 6 is pivotably arranged with a cylindrical cam 7 engageable with the pulley 5, and a drive gear 8 connected to the cylindrical cam 7 by way of a damper spring 11 (spiral spring) to be operated.

The cam 7 is arranged on a side of the pulley 5 of the drive gear 8, and a cam claw 10 formed at the cam 7 is opposed to a centrifugal ratchet 9 provided at a side face of the pulley 5 to be locked thereby. The centrifugal ratchet 9 is urged by a spring 12 to be always locked by the cam 7. Thereby, when the cam 7 is rotated in one direction, the centrifugal ratchet 9 is engaged with the cam claw 10 and therefore, the pulley 5 is rotated and when rotated in a reverse direction, the cam is idly rotated and the pulley 5 is not rotated. When the pulley 5 is rotated, the engine is rotated to thereby rotate the pulley 5 by the engine, the centrifugal ratchet 9 is pivoted in a direction of being detached from the cam claw 10 by a centrifugal force to be constituted to cut transmission of rotation between a side of the engine and a side of the cam 7.

Further, a ring-like recess portion 13 is formed on the side of the cam 7 of a gear portion of the drive gear 8, and the ring-like recess portion 13 is arranged with the damper spring 11. One end of the damper spring 11 is locked by the drive gear 8 and other end thereof is locked by the cam 7. Thereby, when the drive gear 8 is rotated, the damper spring 11 is wound up and a rotational force is stored at the damper spring 11 and when the stored force is equal to or larger than a constant value, the cam 7 is rotated. Further, claws 14, 15 are formed at a side face of the drive gear 8 on a side opposed to the cam 7.

Both of recoil starting and motor starting are constituted to rotate the drive gear 8.

A mechanism of transmitting rotation by recoil starting is constituted as follows. That is, the rope reel 1 is rotatably supported by the support shaft 6 of the drive gear 8 on a side opposed to the cam 7. An outer peripheral side of the rope reel 1 is formed with a rope containing groove 16, and an inner peripheral side thereof is formed with a circular plate containing portion 17. The starter rope 2 is wound around the rope containing groove 16, one end 2*a* thereof is drawn to outside of the starter case 4, and an end portion thereof on a base end side comes out from a hole (not illustrated) of a bottom portion of the containing groove 16 to outside to be retained so as not to be drawn from the rope reel 1. By pulling the one end, the starter rope 2 is drawn out from the rope reel 1 and the rope reel 1 is driven to rotate on the reel support shaft 6. The circular plate containing portion 17 is provided with a circular plate 19 having the ratchet claw 15 engaged and disengaged with and from the ratchet claw 14 of the drive gear 8 movably in an axial direction of the support shaft 6 and the circular plate 19 is urged to be always engaged with the ratchet claw 14 of the drive gear 8 by a compression spring 18. The circular plate 19 is provided movably along a cylinder portion 1*a* on the inner peripheral side of the rope reel 1.

A mechanism for transmitting rotation to the drive gear 8 by the cell motor 3 is constituted by two pieces of reduction gears. That is, a first reduction gear 23 is brought in mesh to be connected with a gear 22 of an output shaft 21 of the cell motor 3 (driven by a battery), a second reduction gear 24 is brought in mesh to be connected with a first small diameter gear portion 23*a* of the first reduction gear 23, and the second reduction gear 24 is brought in mesh with a gear 25 at an outer periphery of the drive gear 8. Further, the second reduction gear 24 brought in mesh with the drive gear 8 is divided into a second small diameter gear portion 24*a* and a large diameter gear portion 24*b* and is rotatably supported by a common rotating shaft 26. The second small diameter gear portion 24*a* is brought in mesh with the drive gear 8, and the large diameter gear portion 24*b* is brought in mesh with the first small diameter gear portion 23*a* of the first reduction gear 23. Further, the large diameter gear portion 24*b* is arranged to be able to be brought into contact and separated with and from the first small diameter gear portion 23*a* by moving along the rotating shaft 26.

Figure 5:
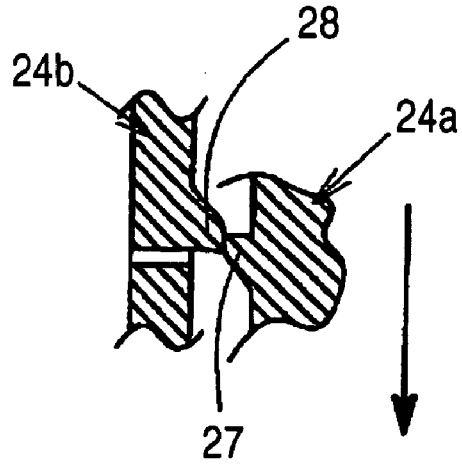
FIG. 5 is a sectional view showing a state in which engaging claws of the small diameter gear portion and the large diameter gear portion are not engaged with each other.
Figure 6:
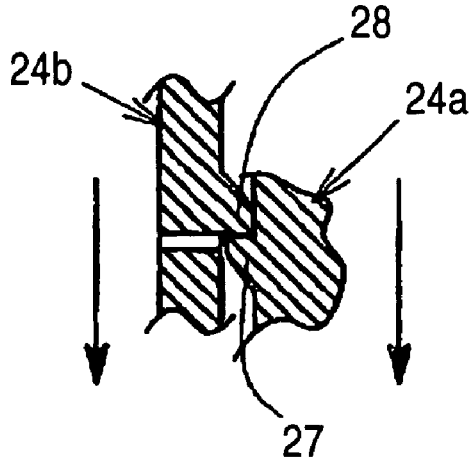
FIG. 6 is a sectional view showing a state of engaging the engaging claws of the small diameter gear portion and the large diameter gear portion.

Side faces of the small diameter gear portion 24*a* and the large diameter gear portion 24*b* opposed to each other are respectively formed with 3 pieces of engaging claws 27, 28. As shown by FIGS. 3A and 3B and FIGS. 4A and 4B, one face of each of the engaging claws 27, 28 in a circumferential direction is formed to be inclined and other face thereof is formed to be orthogonal to the side face. Further, as shown by FIG. 6, when the engaging claws 27, 28 are rotated in one direction, the vertical faces are engaged with each other to rotate the two gear portions and when rotated to reverse sides, as shown by FIG. 5, the inclined faces are formed to be butted not to be engaged to idly rotate one gear portion. Further, a compression spring 29 is arranged between the starter case 4 and the large diameter gear portion 24*b*, the large diameter gear portion 24*b* is pressed to a side of the small diameter gear portion 24*a* and the two side faces of the large diameter gear portion 24*b* and the second small diameter gear portion 24*a* are urged to be brought into contact with each other by the compression spring 29.

Next, an operational mode of the starting apparatus having the above-descried constitution will be explained as follows.

Figure 7:
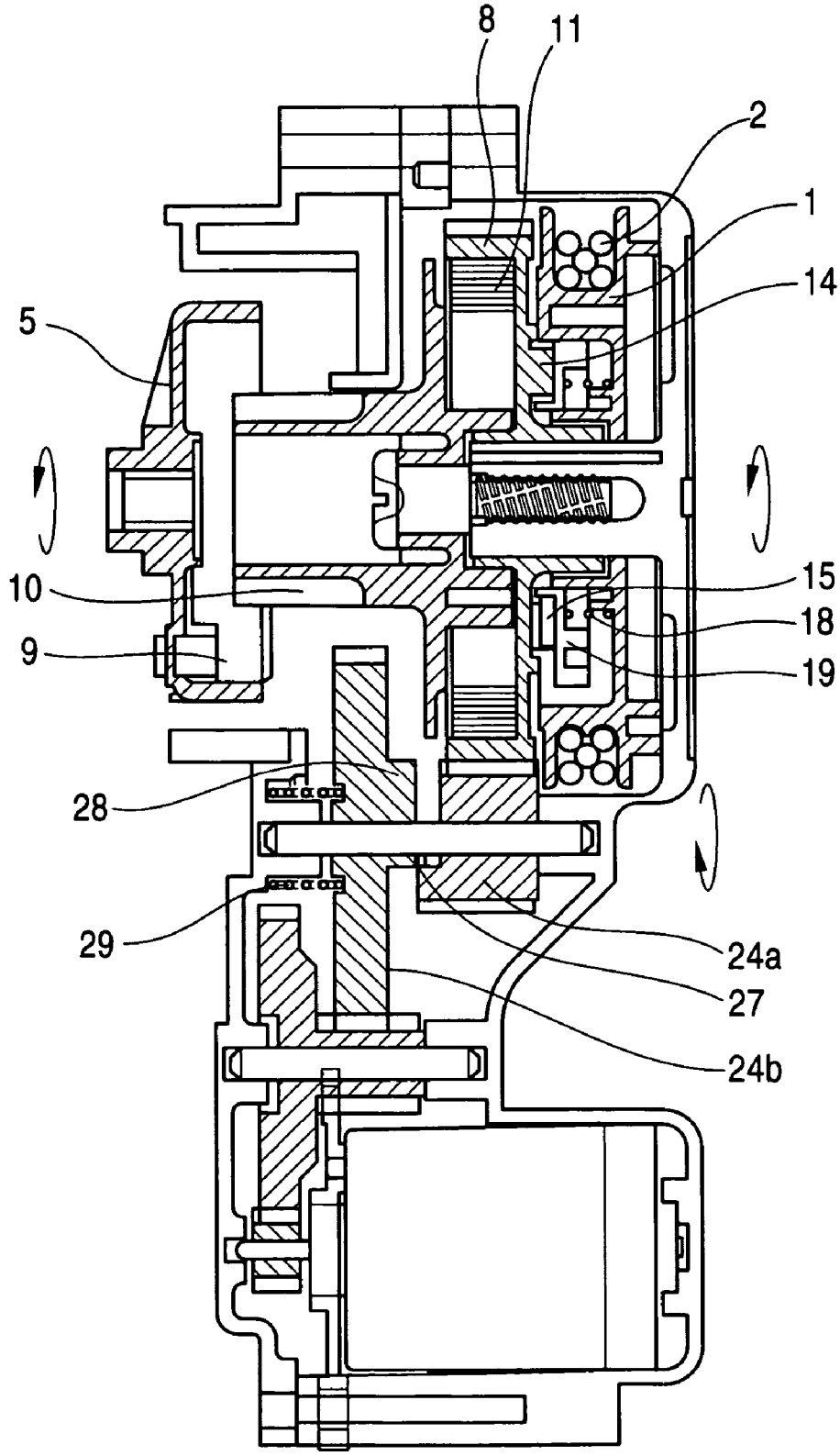
FIG. 7 is a vertical sectional side view of the starter in recoil starting.

In starting by recoil starting, when the rope reel 1 is rotated by pulling the starter rope 2, as shown by FIG. 7, the drive gear 8 is rotated since the ratchet claw 15 of the circular plate 19 and the ratchet claw 14 of the drive gear 8 are urged by the compression spring 18 to be engaged to each other. When the drive gear 8 is rotated, a rotational load thereof is increased by a starting resistance of the engine to increase a load of the cam 7 and therefore, the damper spring 11 is wound to be fastened. When the damper spring 11 is wound up, the rotational force is stored at the damper spring 11 and when the stored force becomes equal to or larger than the constant value, the cam 7 is rotated in one motion. The cam claw 10 of the cam 7 is urged to be always engaged with the centrifugal ratchet 9 and therefore, the pulley 5 is rotated by rotating the cam 7 in one direction, and the engine connected to the pulley 5 is started.

In starting by recoil starting, when the drive gear 8 is rotated, the rotation is transmitted also to the second small diameter gear portion 24*a* of the second reduction gear 24 and therefore, also the second small diameter gear portion 24*a* is rotated. However, in the case of the rotational direction, as shown by FIG. 5 and FIG. 7, the inclined faces of the engaging claws 27, 28 of the second small diameter gear portion 24*a* and the large diameter gear portion 24*b* are butted to each other to ride over and therefore, the engaging claws 27, 28 cannot be engaged with each other, further, from a relationship of a reduction ratio, a torque of rotating the large diameter gear portion 24*b* is larger than a rotation resisting torque between the large diameter gear portion 24*b* and the small diameter gear portion 24*a* effected by a spring force of the compression spring 29 and therefore, the large diameter gear portion 24*b* is locked and is moved to be separated from the second small diameter gear portion 24*a* on the rotating shaft 26 against the compression spring 29. Therefore, only the small diameter gear portion 24*a* is idly rotated and the rotational force of the drive gear 8 is not transmitted to the large diameter gear portion 24*b*.

When the pulley 5 is rotated by the started engine, the centrifugal ratchet 9 is pivoted in the direction of being detached from the cam claw 10 by the centrifugal force in accordance with the rotation, and transmission of rotation between the side of the engine and the side of the cam 7 is cut.

Next, in starting by motor starting, electricity is fed from the battery to the cell motor 3. Thereby, the rotational force is transmitted from the gear 22 fixed to the output shaft 21 to the large diameter gear portion 24*b* of the second reduction gear 24 by way of the first reduction gear 23. The large diameter gear portion 24*b* is pressed to the second small diameter gear portion 24*a* by the compression spring 29, further, when the large diameter gear portion 24*b* is rotated, in the rotational direction, as shown by FIG. 2, the engaging claws 27, 28 of the second small diameter gear portion 24*a* and the large diameter gear portion 24*b* are engaged with each other and therefore, also the second small diameter gear portion 24*a* is rotated and the rotational force is transmitted to the drive gear 8. When the drive gear 8 is rotated, the rotational load is increased by the starting resistance of the engine to increase the load of the cam 7 and therefore, the damper spring 11 is wound to be fastened. When the damper spring 11 is wound up, the rotational force is stored to the damper spring 11 and when the stored force becomes equal to or larger than the constant value, the cam 7 is rotated in one motion. The cam claw 10 of the cam 7 is urged to be always engaged with the centrifugal ratchet 9 and therefore, the pulley 5 is rotated by rotating the cam 7 in one direction and the engine connected to the pulley 5 is started.

In this way, in starting by motor starting, when the drive gear 8 is rotated as described above, in the rotational direction, as shown by FIG. 2, the inclined faces of the ratchet claw 14 of the drive gear 8 and the ratchet claw 15 of the circular plate 19 of the rope reel 1 are butted to each other to ride over against the compression spring 18, the ratchet claws 14, 15 are not engaged with each other and therefore, the ratchet claws 14, 15 are separated from each other and the rotational force of the drive gear 8 is not transmitted to the rope reel 1.

As described above, a one way mechanism is constituted by engaging and disengaging the engaging claws 27, 28 and therefore, the rotation of the rope reel or the cell motor is firmly transmitted to the predetermined transmission system. Therefore, the engine is started selectively by either of starting by the cell motor 3 or starting by recoil starting.

Further, the second small diameter gear portion 24*a* and the large diameter gear portion 24*b* are inexpensive, both thereof may rotatably be supported by the support shaft 6 and are not needed to be press-fitted with the support shaft 6, further, the dimensional accuracy is not required therefor, and the both are not needed to be quenched or the like and therefore, a number of integrating steps and cost can be reduced.

Further, the phenomenon that the force is not transmitted is difficult to be brought about even at low temperatures and a low temperature characteristic is promoted. Further, even when a load is applied on the second small diameter gear portion 24*a* and the large diameter gear portion 24*b* in the radial direction, the torque is transmitted sufficiently and the reliability is significantly promoted.

What is claimed is:

1. A starting apparatus of a small-sized engine comprising:

a cylindrical cam having a cam claw engaged with a centrifugal ratchet of a pulley fixed to a crankshaft of an engine; and a drive gear connected to the cylindrical cam by a damper spring at an inner portion of a starter case, the cylindrical cam being coaxially arranged with the drive gear, wherein the drive gear is connectable to a rope reel engaged therewith and disengaged therefrom by ratchet claws formed at respective side faces thereof, and wherein the drive gear is connectable to an output shaft gear of a cell motor by at least two reduction gears, a first one of the reduction gears engageable with the drive gear including a small diameter gear portion and a large diameter gear portion arranged coaxially, wherein side faces of the small diameter gear portion and the large diameter gear portion are opposed to each other and are formed with engaging claws engaged with each other only in one direction, and wherein the small diameter gear portion and the large diameter gear portion are axially urged into contact with each other via a spring acting on one of the small diameter gear portion and the large diameter gear portion.

2. A starting apparatus of a small-sized engine comprising:

a cylindrical cam having a cam claw engaged with a centrifugal ratchet of a pulley fixed to a crankshaft of an engine;

a drive gear connected to the cylindrical cam by a damper spring at an inner portion of a starter case, the cylindrical cam being coaxially arranged with the drive gear;

a recoil starter including a rope reel coaxial with the drive gear on which a starter rope is wound, the rope reel being selectively engageable with the drive gear; and a cell motor starter including a cell motor with an output shaft, and an output shaft gear connected to the output shaft, the cell motor starter further including at least two reduction gears selectively coupling the output shaft gear with the drive gear according to a rotation direction of the reduction gears, wherein a first one of the reduction gears includes a small diameter gear portion and a large diameter gear portion arranged coaxially, and wherein the small diameter gear portion and the large diameter gear portion are axially urged into contact with each other via a spring acting on one of the small diameter gear portion and the large diameter gear portion.

* * * * *